US006500482B1

(12) United States Patent
Morcos

(10) Patent No.: US 6,500,482 B1
(45) Date of Patent: Dec. 31, 2002

(54) ELECTROLESS NICKEL PLATING SOLUTION AND PROCESS FOR ITS USE

(76) Inventor: Boules H. Morcos, 40007 Sandpoint Way, Novi, MI (US) 48375

( * ) Notice: Subject to any disclaimer, the term of this patent is extended or adjusted under 35 U.S.C. 154(b) by 0 days.

(21) Appl. No.: 09/945,011

(22) Filed: Aug. 31, 2001

(51) Int. Cl.[7] ..... B05D 1/18
(52) U.S. Cl. ..... 427/8; 427/438; 427/443.1
(58) Field of Search ..... 427/8, 430.1, 443.1, 427/438

(56) References Cited

U.S. PATENT DOCUMENTS 4,692,346 A * 9/1987 McBride et al. ..... 427/10
4,780,342 A * 10/1988 LeBlanc, Jr. ..... 106/1.22
5,112,392 A * 5/1992 Anderson et al. ..... 106/1.22
5,609,767 A * 3/1997 Eisenmann ..... 106/1.22
5,635,253 A * 6/1997 Canaperi et al. ..... 427/437

* cited by examiner

*Primary Examiner*—Michael Barr
(74) *Attorney, Agent, or Firm*—Carmody & Torrance LLP

(57) ABSTRACT

A process for electrolessly plating nickel-phosphorous is disclosed which allows for adjusting and maintaining pH by adding, with mixing, a strong alkali, such as alkali metal hydroxides, to the electroless nickel plating solution which has been previously cooled to below about 140° F. (i.e. below normal operating temperature) on a regular or continuous basis. Preferably, the strong alkali is a solution of alkali metal hydroxides which contain less than about 700 g/l of alkali metal hydroxide.

3 Claims, 1 Drawing Sheet

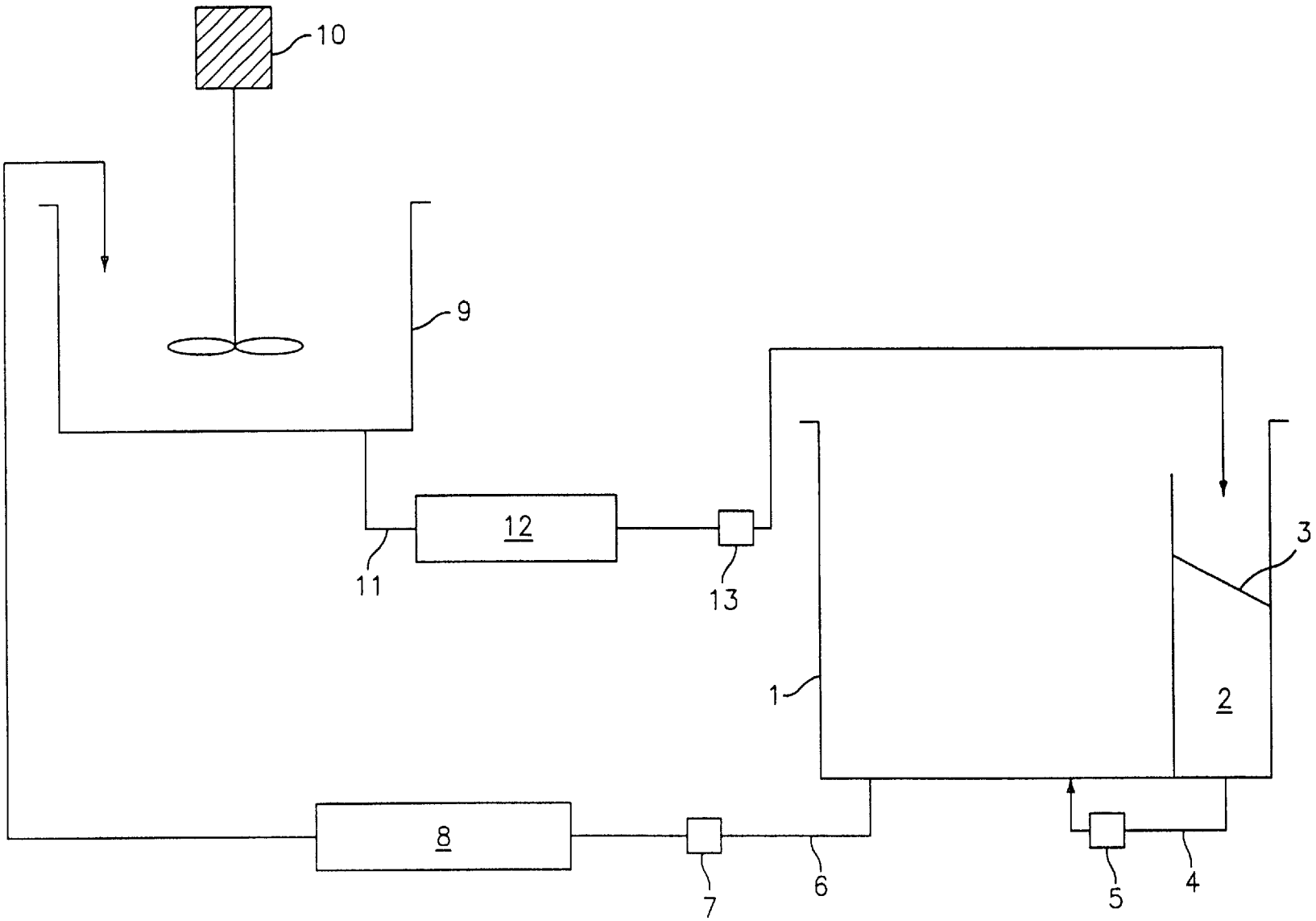
3
2
4
5
6
1
13
7
12
8
9
11
10

ELECTROLESS NICKEL PLATING SOLUTION AND PROCESS FOR ITS USE

FIELD OF THE INVENTION

This invention relates to a novel composition and process for its use in electrolessly plating nickel deposits. The composition and process all for the electroless plating of nickel without the use of ammonium hydroxide, which has objectionable odor, complicates water waste treatment and is considered an air pollutant.

BACKGROUND OF THE INVENTION

Methods for the electroless deposition of metals are now widely known and used in industry to deposit a variety of metals, including nickel onto various substrates. In general, electroless deposition compositions contain a salt of the metal to be deposited, a reducing agent capable of reducing metal ions to the metal in the presence of a catalytic surface, a chelating agent to maintain the metal in solution, and a pH-adjusting agent. Other substances such as stabilizers, brighteners, surfactants and other similar additives may also be present.

Electroless nickel plating solutions are probably the most widely used electroless plating solutions. These plating solutions are a delicate blend of several ingredients, each performing specific functions. They generally contain nickel salt such as nickel chloride, nickel carbonate and/or nickel sulfate. In addition they can be chelated with a variety of organic acids and chelators. The most widely used electroless nickel baths in industry today utilize the hypophosphate ion as a reducing agent and use aqueous ammonia to adjust the pH of the solution. These plating solutions can also employ various stabilizers, buffers, and surfactants. Electroless nickel plating commercially occurs at temperatures ranging from about 175° to 195° F.

Electroless nickel compositions of this type are generally replenishable in that while they are used to plate nickel, the nickel, chelator, reducing agent and other components may be added back to the bath in concentrated form to replace the constituents used in plating. In this manner, the bath is maintained in peak condition for continuous or repeated use for many metal turnovers. One metal turnover is reached when metal is plated out of the bath in an amount equal to the initial, starting metal content in the bath.

As plating continues however, the pH of the solution will drop and this will need to be monitored and adjusted higher to keep the bath in optimum condition for plating. The pH of the solution naturally drops during plating because the plating reaction produces hydrogen in both gaseous and ionic form. This production of hydrogen obviously continues to acidify the solution as plating proceeds. Generally, pH maintenance is accomplished with the addition of aqueous ammonia and pH is controlled within the range of about 4–7. In addition to the use of ammonia, pH is also controlled to some extent by buffers in the plating solution.

Historically, alkali stronger than ammonium hydroxide, such as alkali metal hydroxides, have not been useful in controlling the pH of electroless nickel solutions of this type, since they have generally been found to adversely affect the stability of the plating solution and/or the quality of the deposit. In some cases they have been found to cause catastrophic solution failure. In part, these difficulties are believed to be due in part to the fact that alkali metal hydroxides lack the ability to chelate nickel ions and that they may cause sharp changes in pH on a localized basis.

However, despite these difficulties, efforts continue to develop an electroless nickel hypophosphite plating process which can effectively use alkali metal hydroxides to adjust and maintain pH. It is believed that use of alkali metal hydroxides in this manner would be advantageous since the plating solution would be easier to waste treat than those containing ammonia, and since the concentrated nature of the alkali metal hydroxides can also provide advantages.

Thus, it is an object of this invention to provide a process for electrolessly plating nickel which process utilizes, at least in part, alkali metal hydroxides to adjust and maintain the pH of the plating solution.

SUMMARY OF THE INVENTION

The inventors herein propose a process for plating electroless nickel from a nickel hypophosphite plating solution wherein a portion of the plating solution is continuously or regularly removed from the plating tank (i.e. the tank where plating occurs), cooled to below about 140° F. and placed in a container separate from the plating tank. While in the separate container, the removed portion of the plating solution is mixed, the pH is measured, and alkali metal hydroxide is added with mixing in order to adjust the pH of the removed portion of the plating solution to within the optimum range. The removed portion of the plating solution is preferably then filtered and then it is returned to the plating tank. Replenishment of other materials such as nickel salts, chelators, reducing agent and other additives may occur in the separate container or in the plating tank, however, alkali metal hydroxides are preferably only added in the separate container, with mixing, and after the removed portion of the plating solution is cooled to less than about 140° F.

BRIEF DESCRIPTION OF THE DRAWING

The FIGURE represents a flow diagram of a preferred embodiment of the present invention. Referring to the FIGURE, the following components of the process are specified.

1—Plating tank, 1, is generally constructed of stress relieved polypropylene, high temperature reinforced plastic, plastic coated stainless steel, or passivated stainless steel. The construction of plating tank, 1, must be such that it can reliably contain the plating solution at temperatures from about 175° F. to about 195° F. The size of plating tank, 1, will vary based upon the size and number of parts to be plated in each batch.

2—Overflow weir, 2, represents a segregated section of plating tank, 1, into which the solution from the main chamber of plating tank, 1, overflows. The overflowed solution is filtered through membrane, 3, and then returned to the main chamber of plating tank, 1.

3—Filtration membrane, 3, spans the opening of the overflow weir, 2, such that all solution flowing into overflow weir, 2, flows through filtration membrane, 3. The Filtration membrane, 3, is typically composed of filter cloth with a filtration size of from 1 to 5 microns. Filtration membrane, 3, may be a bag filter.

4—Recycle piping, 4, allows the solution from overflow sump, 2, to be recycled to the main chamber of plating tank, 1.

5—Recycle pump, 5, pumps the solution from overflow chamber, 2, through recycle piping, 4, back to the main chamber of plating tank, 1.

6—Removal piping, 6 conveys the solution through pump, 7, and cooling heat exchanger, 8, to replenishment tank, 9.

7—Removal pump, 7, pumps the solution from plating tank, 1, through cooling heat exchanger, 8, to replenishment tank, 9.

8—Cooling heat exchanger, 8, cools the solution which passes through removal piping, 6, on its way to replenishment tank, 9.

9—Replenishment tank, 9, is constructed from the same or similar materials as plating tank, 1. The size of the replenishment tank will generally depend on the size of the plating tank and should preferably range from 20 to 30 percent of the volume of the plating tank.

10—Mixing means, 10, may consist of an electric or air driven impeller mixer as pictured in the FIGURE or may consist of other means of mixing such as pumping or air sparging.

11—Return piping, 11, conveys the solution from replenishment tank, 9, through heating heat exchanger, 12, to overflow weir, 2.

12—Heating heat exchanger, 12, heats the solution which passes through the return piping, 11.

13—Return pump, 13, pumps the solution from replenishment tank, 9, through heating heat exchanger, 12, to overflow weir, 2.

DETAILED DESCRIPTION OF THE INVENTION

The inventors herein have surprisingly discovered that it is possible to adjust and maintain the pH of electroless nickel-hypophosphite plating solutions with strong alkali such as alkali metal hydroxides, provided that the electroless plating solution is cooled to below about 140° F. prior to and during the pH adjustment, effective mixing is employed during the pH adjustment and preferably, the concentration of the alkali metal hydroxide in the replenishment solution is less than about 700 g/l. Electroless nickel solutions, prepared and operated in accordance with this process are easier to waste treat than similar electroless nickel solutions which contain ammonium hydroxide as a pH adjusting agent.

The electroless nickel plating compositions of the present invention comprise: (a) water, (b) a soluble source of nickel ions, (c) complexing agents, (d) a reducing agent capable of reducing the nickel ions to nickel metal in the presence of a catalytic surface, preferably a soluble source of hypophosphite ions, and (e) an alkali metal hydroxide or alkaline earth hydroxide as a pH adjusting or maintenance agent. In addition to the foregoing, the solution may also contain stabilizers, brighteners, surfactants, buffers and other similar additives. Preferably, the solution will be substantially free of ammonia and ammonium ions.

The soluble source of nickel ions generally will be nickel sulfate because of its availability, cost, and solubility and because it is not a source of ammonium ions, however, any nickel salt which meets the criteria of solubility and is preferably ammonium ion free would be suitable. The concentration of nickel from the nickel salt in the plating solution can range, for example, from about 2 to about 25 grams per liter and preferably will be from about 4 to about 8 grams per liter.

The reducing agent will preferably be a hypophosphite, particularly sodium hypophosphite. The concentration of hypophosphite in the plating solution can range from about 10 to about 40 grams per liter, but is preferably from about 18 to about 24 grams per liter.

The chelating agents can vary greatly including a variety of organic acids such as citric acid, lactic acid, tartaric acid, succinic acid, malic acid, maleic acid and gluconic acid or salts of any of the foregoing; amine acids such as glycine, alanine, ethylene diamine, tetraacetic acid, and pyrophosphates. It can be seen from this list that ingredients containing amine functional groups are acceptable as opposed to ingredients containing free ammonia or ammonium ions which are preferably absent. The total chelating agent concentration should generally be in slight to moderate stoichiometric excess to the nickel ion concentration.

The composition must also have a pH adjusting an/or maintenance agent, which is preferably free of ammonia and ammonium ions. Suitable pH adjusting/maintenance agents include alkali metal hydroxides and alkali earth hydroxides such as sodium hydroxide or potassium hydroxide. Alkaline carbonates may also be used. The pH of the composition should preferably be maintained in the range of from about 4 to about 7, more preferably from about 4.5 to about 6.

In addition to the foregoing, the composition may also contain stabilizers, surfactants, buffers and other similar additives Lead compounds such as lead acetate are regularly added to these compositions at concentrations of a few ppm to stabilize the composition and inhibit indiscriminate plating. Other stabilizing additives are known. Surfactants may be added for a variety of functions including as materials which assist in refining the grain of the nickel deposit. Buffers such as carbonates are used to stabilize the pH of the composition.

In order to effectively plate, the composition will be heated to between about 175° F. and 195° F., preferably between about 185° F. and 195° F. Temperatures lower than the foregoing produce unreasonably low plating rates and unreliable plating. Catalytic surfaces are then typically immersed in the solution for plating As plating continues hydrogen is evolved both as a gas and in ionic form. As a result, as plating continues, the pH of the composition is depressed and must be continually adjusted in order to maintain it in its optimum range.

If strong alkali are used to adjust and maintain the pH, the inventors have discovered that it is essential to cool the composition to below about 140° F. before adding the alkali and thoroughly mix the composition while adding the alkali. This is a substantial deviation from current practice with electroless nickel plating solutions where weak alkali such as ammonium hydroxide are added directly to the plating solution, during plating (i.e. while the temperature of the solution is in the operating range) and without special attention to mixing. However use of the foregoing practice with strong alkali such as sodium hydroxide has invariably caused the plating solution to become unstable and either detrimentally affect the nickel plate or cause catastrophic failure of the plating solution. In contrast, through use of the process of this invention strong alkali can be effectively used to adjust and maintain the pH of these plating solutions without detrimental effect.

Thus the inventors propose a process whereby a portion of the plating solution is continuously or regularly removed from the plating task and cooled to less than about 140° F. This removed cooled portion of the solution is then subjected to mixing means and then the pH is monitored and adjusted by adding a strong alkali such as sodium hydroxide or potassium hydroxide. The concentration of the alkali metal hydroxide which is added to the removed cooled portion of the plating solution is preferably between about 400 g/l and 700 g/l. Other maintenance agents such as nickel salts, reducing agent, chelating agent and/or other additives may also be added at this point. The removed cooled portion of the plating solution is then continuously or regularly returned to the plating tank. Preferably the cooled portion of the plating composition is heated to above about 165° F. after the pH adjusting agent is added but before returning such portion to the plating tank.

In order to accomplish the foregoing process in a preferred manner, the inventors have proposed a preferred process layout which is schematically depicted in the FIGURE. Thus, referring to the FIGURE, a portion of the electroless nickel plating solution is removed from plating tank, 1, through removal piping, 6, with the use of removal pump, 7, and sent through cooling heat exchanger, 8, where the plating solution is cooled to less than about 140° F., to replenishment tank, 9. In replenishment tank, 9, the pH is monitored and adjusted with solution of strong alkali such as sodium hydroxide or potassium hydroxide. The solution of strong alkali should preferably comprise less than about 700 g/l of strong alkali. The electroless nickel from replenishment tank, 9, is then sent through return piping, 11, by means return pump, 13, through heating heat exchange, 12, where it is heated back to operating temperature, to overflow weir, 2, of plating tank, 1. In overflow weir, 2, the solution is filtered through filtration membrane, 3, and then continuously returned to plating tank, 1, via recycle piping, 4, and recycle pump, 5.

The invention is further described by the following example which should be taken as illustrative only and not limiting in any way.

EXAMPLE I

An electroless nickel plating solution of the following formulation was prepared:

| COMPONENT | CONCENTRATION |
|---|---|
| Nickel sulfate | 34 g/l |
| Succinic Acid | 12 g/l |
| Lactic Acid (88%) | 20 g/l |
| Glycine | 20 g/l |
| Malic Acid | 25 g/l |
| Sodium Hypophosphite | 33 g/l |
| Potassium Hydroxide | To pH of 4.8 |

The solution was then placed in a plating tank heated to a temperature of 190° F. The solution was used to plate parts with electroless nickel and at the same time was processed through the equipment depicted in the FIGURE. In the replenishment tank, all ingredients were added back to the plating solution such that it was kept in optimum plating condition. In addition, in the replenishment tank, the pH of the solution was monitored and adjusted by adding a solution of 700 g/l sodium hydroxide.

The solution was continually used to electrolessly plate nickel until the solution reached 6 metal turnovers. During that time, the electroless nickel plate was acceptable in all aspects.

What is claimed is:

1. A process for electrolessly plating nickel, which process comprises contacting a substrate with a plating composition contained within a plating tank, which plating composition comprises:

(a) a soluble source of nickel ions;

(b) complexing agents;

(c) a hypophosphite reducing agent; and (d) a pH adjusting agent selected from the group consisting of alkali metal hydroxides, alkaline earth hydroxides, and mixtures of the foregoing;

wherein a portion of the plating composition is regularly or continually removed from the plating tank, cooled to below about 140° F., and then the pH of the removed and cooled portion of the plating solution is monitored and adjusted by adding the pH adjusting agent with mixing, and thereafter returning the removed and cooled portion of the plating composition to the plating tank wherein the pH adjusting agent is a solution of an alkali metal hydroxide comprising less than about 700 g/l of alkali metal hydroxide.

2. A process according to claim 1 wherein the removed and cooled portion of the plating composition is heated to above about 165° F. after the pH adjusting agent is added but before returning such portion to the plating tank.

3. A process according to claim 1 wherein the removed and cooled portion of the plating composition is filtered prior to returning such portion to the plating tank.

* * * * *